US006224462B1

(12) United States Patent
Yokoyama et al.

(10) Patent No.: US 6,224,462 B1
(45) Date of Patent: May 1, 2001

(54) GRINDING MACHINE

(75) Inventors: Shigeru Yokoyama; Hiroshi Yanagisawa, both of Abiko (JP)

(73) Assignee: Hitachi Seiki Co., Ltd., Abiko (JP)

( * ) Notice: Subject to any disclaimer, the term of this patent is extended or adjusted under 35 U.S.C. 154(b) by 0 days.

(21) Appl. No.: 09/507,384

(22) Filed: Feb. 18, 2000

(30) Foreign Application Priority Data

Feb. 22, 1999 (JP) ..... 11-042802

(51) Int. Cl.[7] ..... B24B 49/18

(52) U.S. Cl. ..... 451/10; 451/9; 451/11; 451/56; 451/215; 451/443; 451/450

(58) Field of Search ..... 451/8, 9, 10, 11, 451/14, 56, 24, 178, 212, 213, 215, 221, 443, 449, 450

(56) References Cited

U.S. PATENT DOCUMENTS

| | | | | |
|---|---|---|---|---|
| 4,417,422 | | 11/1983 | Redeker et al. . | |
| 4,458,660 | * | 7/1984 | Vlk et al. | 451/56 |
| 5,738,564 | * | 4/1998 | Helle et al. | 451/11 |
| 5,766,057 | * | 6/1998 | Maack | 451/56 |

FOREIGN PATENT DOCUMENTS

| | | |
|---|---|---|
| 62-199358 | 9/1987 | (JP) . |
| 3-27342 | 4/1991 | (JP) . |
| 6-37031 | 5/1994 | (JP) . |

OTHER PUBLICATIONS

Machine tool series, Advanced grinding technology entitled "Continuous dressing creep feed grinding"; pp. 55–60. Discussed in the spec.
Machinist; vol. 27, No. 11, pp. 68–71.

* cited by examiner

*Primary Examiner*—Eileen P. Morgan
(74) *Attorney, Agent, or Firm*—Armstrong, Westerman, Hattori, McLeland & Naughton, LLP

(57) ABSTRACT

A grinding machine includes a main spindle on which a grinding wheel is mounted, a spindle head movable relative to a workpiece, a dressing device body provided to be movable relative to the spindle head and a dresser supporting member provided to be movable relative to the dressing device body for rotatably supporting a dresser. The dressing device body is moved to a dressing position while the grinding machine grinds with continuous dressing. The dressing device body is moved to a retracted position while the grinding machine normally grinds except for the grinding with continuous dressing.

22 Claims, 7 Drawing Sheets

GRINDING MACHINE

BACKGROUND OF THE INVENTION

1. Field of the Invention

The present invention relates to a grinding machine for grinding with continuous dressing for a workpiece with a rotating grinding wheel and for normally grinding except for the grinding with continuous dressing.

2. Description of the Related Art

The grinding with continuous dressing, in which a dressing device is provided onto a grinding machine or a grinding center and an operation for dressing a grinding wheel with the dressing device and an operation of grinding the workpiece with the grinding wheel are performed simultaneously, is well known in the art, for example, MACHINE TOOL SERIES, ADVANCED GRINDING TECHNOLOGY (published by Kabushiki Kaisha Taigashuppan on Sep. 20, 1985, pages 55–60) entitled "CONTINUOUS DRESSING-CREEP FEED GRINDING" or the like.

Also, Examined Japanese Patent Publication No. Hei. 3-27342 discloses a grinding machine provided with a dressing device with two grinding spindles.

However, the grinding machine which is disclosed in the above-described Japanese Patent Publication No. Hei 3-27342 takes a structure such that a grinding spindle carrier is moved up and down relative to a column and the dressing device is moved up and down relative to the grinding spindle carrier.

For this reason, it is impossible to move only a grinding head carried on the grinding spindle supported to the grinding spindle carrier. Namely, it is impossible to move only a grinding wheel of the grinding head.

Accordingly, it is difficult to grind a workpiece while a dressing tool and the grinding wheel are separated far away from each other and the grinding wheel is moved round the workpiece so as to avoid an interference between the workpiece and the dressing tool of the dressing device.

Also, the grinding spindle carrier, the column, a motor and a spindle drive portion, or the like, become large in size when the amount of movement of a frame of the dressing device relative to the grinding spindle carrier is increased in order to keep the dressing tool far away from the grinding wheel. In this case, it is necessary to increase an energy consumption since the respective enlarged components should be moved. As a result, the cost is increased.

Furthermore, the grinding machine is provided with two grinding spindle carriers for supporting the grinding spindles and the grinding head having a plurality of grinding wheels is supported to each grinding spindle and a s ingle workpiece may be simultaneously ground by the grinding heads from opposite sides so that the grinding machine is complicatedly structured.

This structure would be suitable for the grinding for specific kinds of turbine blades but suffers from a problem in versatility in order to grind various kinds of workpieces.

Also, Japanese Patent Application Laid-Open No. Sho 62-199359 and Examined Japanese Patent Publication No. Hei 6-37031 disclose a technology for grinding with continuous dressing with a grinding machine. However, according to these pieces of the prior art, a dresser and a dresser driving portion, or the like, are provided on a grinding wheel head, accordingly, it is impossible to keep the dresser, or the like, far away from a grinding wheel and to perform the grinding while the grinding wheel is moved round a workpiece.

SUMMARY OF THE INVENTION

In order to overcome the above-noted defects, an object of the present invention is to provide a grinding machine which may perform both a grinding with continuous dressing and a normal grinding except for the grinding with continuous dressing only with a single grinding machine.

In order to attain this and other objects, according to the present invention, there is provided a grinding machine comprising a main spindle on which a grinding wheel for grinding a workpiece is detachably mounted, a spindle head for rotatably supporting the main spindle, the spindle head being movable relative to the workpiece along at least three mutually transverse axes including a direction in parallel with an axis of the main spindle, a dressing device body provided to be movable relative to the spindle head along at least one direction perpendicular to the axis of the main spindle, and a dresser supporting member provided to be movable relative to the dressing device body along one direction perpendicular to the axis of the main spindle for rotatably supporting at least one dresser for dressing the grinding wheel.

The dressing device body is moved to at least one dressing position in which the dresser may dress the grinding wheel, while the grinding machine grinds with continuous dressing in which an operation of dressing the grinding wheel with the dresser and an operation of grinding the workpiece with the grinding wheel are performed simultaneously. The dressing device body is moved to at least one retracted position at which the workpiece does not interfere with at least dresser, while the grinding machine normally grinds except for the grinding with continuous dressing.

It is preferable that the grinding machine further comprises at least one coupling and releasing means. The coupling and releasing means couples the spindle head and the dressing device body with each other while the grinding machine grinds with continuous dressing, but releases the coupling between the spindle head and the dressing device body while the grinding machine normally grinds the workpiece.

It is preferable that the spindle head is provided to be movable along at least one axial direction of two axial directions perpendicular to the axis of the main spindle, and the dressing device body is controlled to move along the one axial direction together with the main spindle when the dressing device body is kept under a coupled condition by the coupling and releasing means.

It is preferable that the movement direction of the dressing device body is in a vertical direction, and a balancing device for maintaining a weight balance is provided for the dressing device body.

In another embodiment, a driving unit for moving the dressing device body relative to the spindle head is a dressing device fluid pressure cylinder unit, therefore, it is possible that the dressing device fluid pressure cylinder unit avoids affecting a movement control of the spindle head while the grinding machine grinds with continuous dressing.

Furthermore, in still another embodiment of the invention, it is possible that the spindle head is provided to be movable along at least one axial direction of the two axial directions perpendicular to the axis of the main spindle, and a driving unit for moving the dressing device body relative to the spindle head moves and operates the dressing device body in synchronism with a movement and operation along the one axial direction of the spindle head while the grinding machine grinds with continuous dressing.

More preferably, the grinding machine may further comprise a holding means for holding the dressing device body in the retracted position while the grinding machine normally grinds the workpiece.

With such a structure according to the present invention, only with a single grinding machine, it is possible to grind with continuous dressing for the workpiece and to grind the workpiece over an entire circumference by retracting the continuous dressing device in a positive manner while the grinding machine normally grinds except for the grinding with continuous dressing.

BRIEF DESCRIPTION OF THE DRAWINGS

FIGS. 1 to 5A and 5B are views showing a first embodiment of the present invention.

FIG. 1 is a perspective view showing a grinding machine.

FIG. 2 is a schematic structural view showing a primary part of the grinding machine.

FIG. 3 is a cross-sectional view showing a structure of a coupling and releasing means.

FIG. 4 is a schematic structural view of a holding means.

FIGS. 5A and 5B are illustrations of an operation of the grinding machine.

FIG. 5A shows a condition of a grinding with continuous dressing.

FIG. 5B shows a condition of a normal grinding except for the grinding with continuous dressing.

DESCRIPTION OF THE PREFERRED EMBODIMENTS

Embodiments of the present invention will now be described with reference to FIGS. 1 to 7.

First Embodiment

Figure 1:
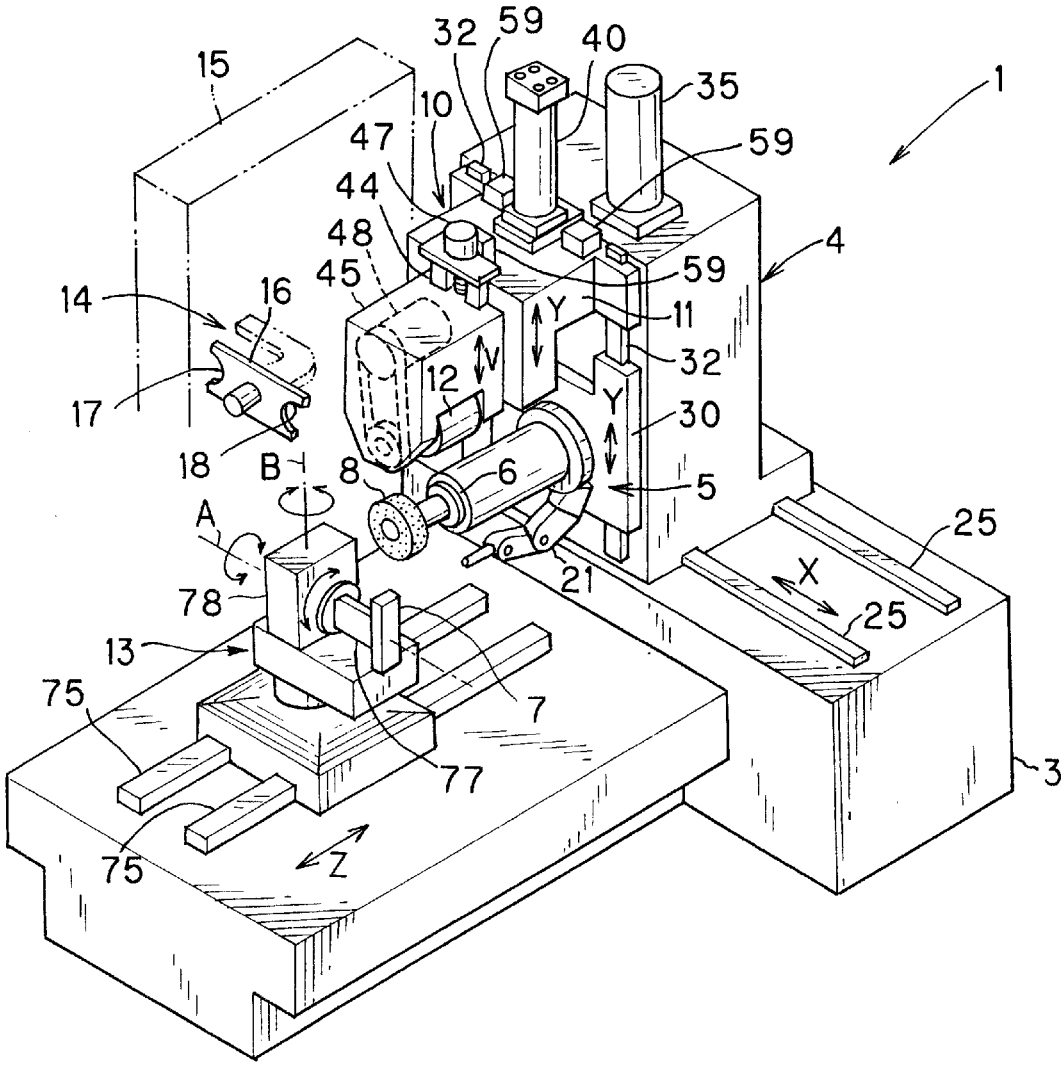
Figure 2:
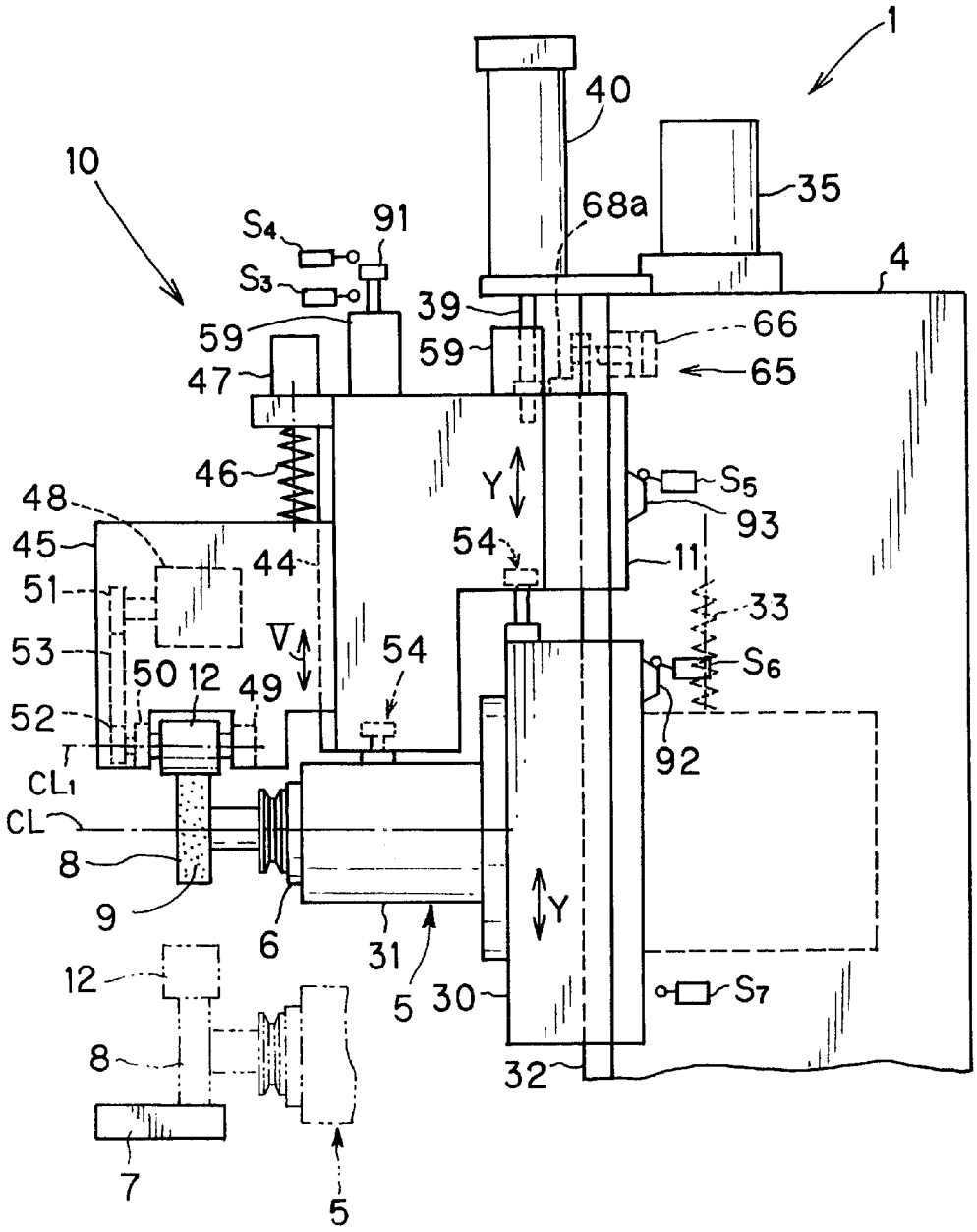
Figure 3:
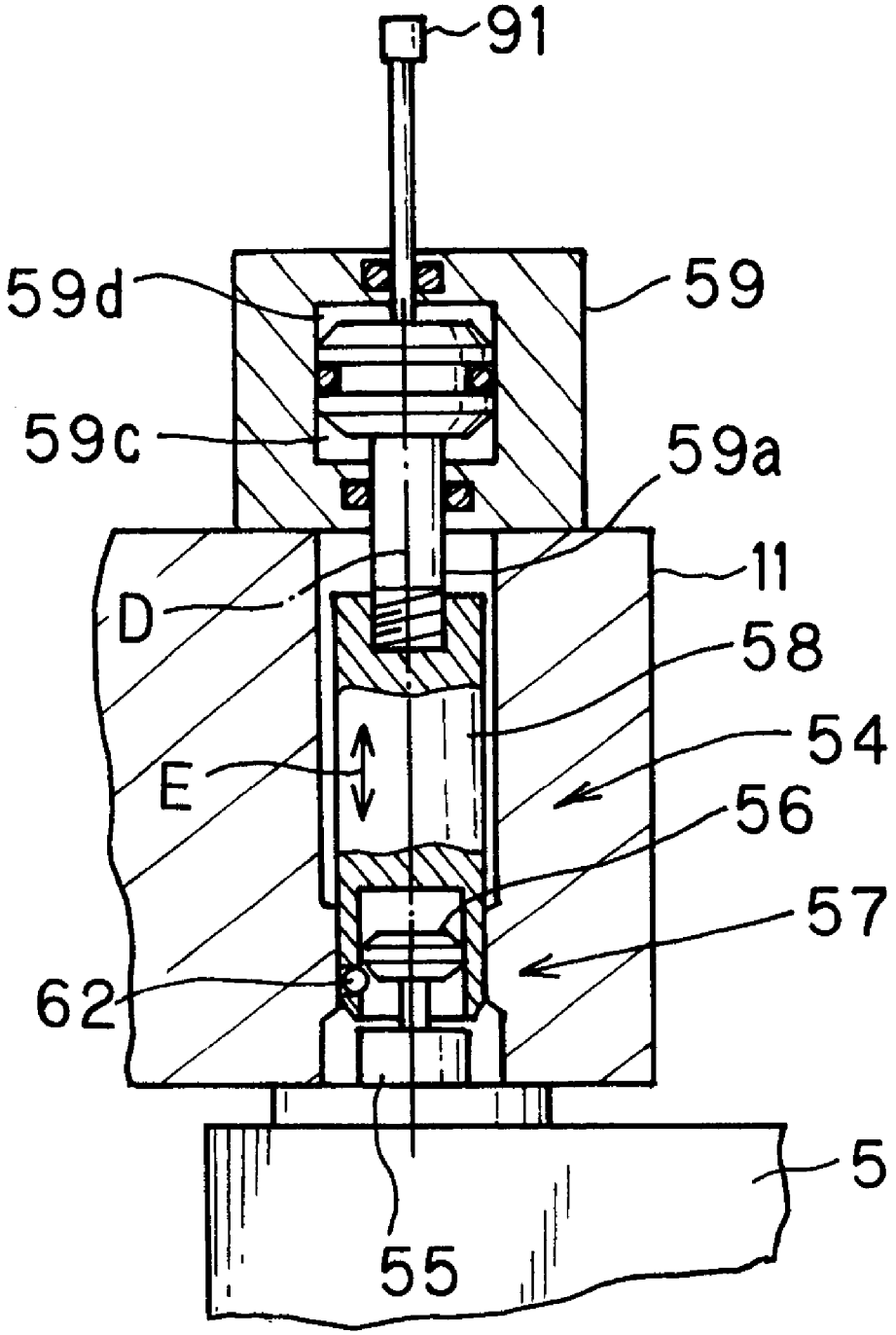
Figure 4:
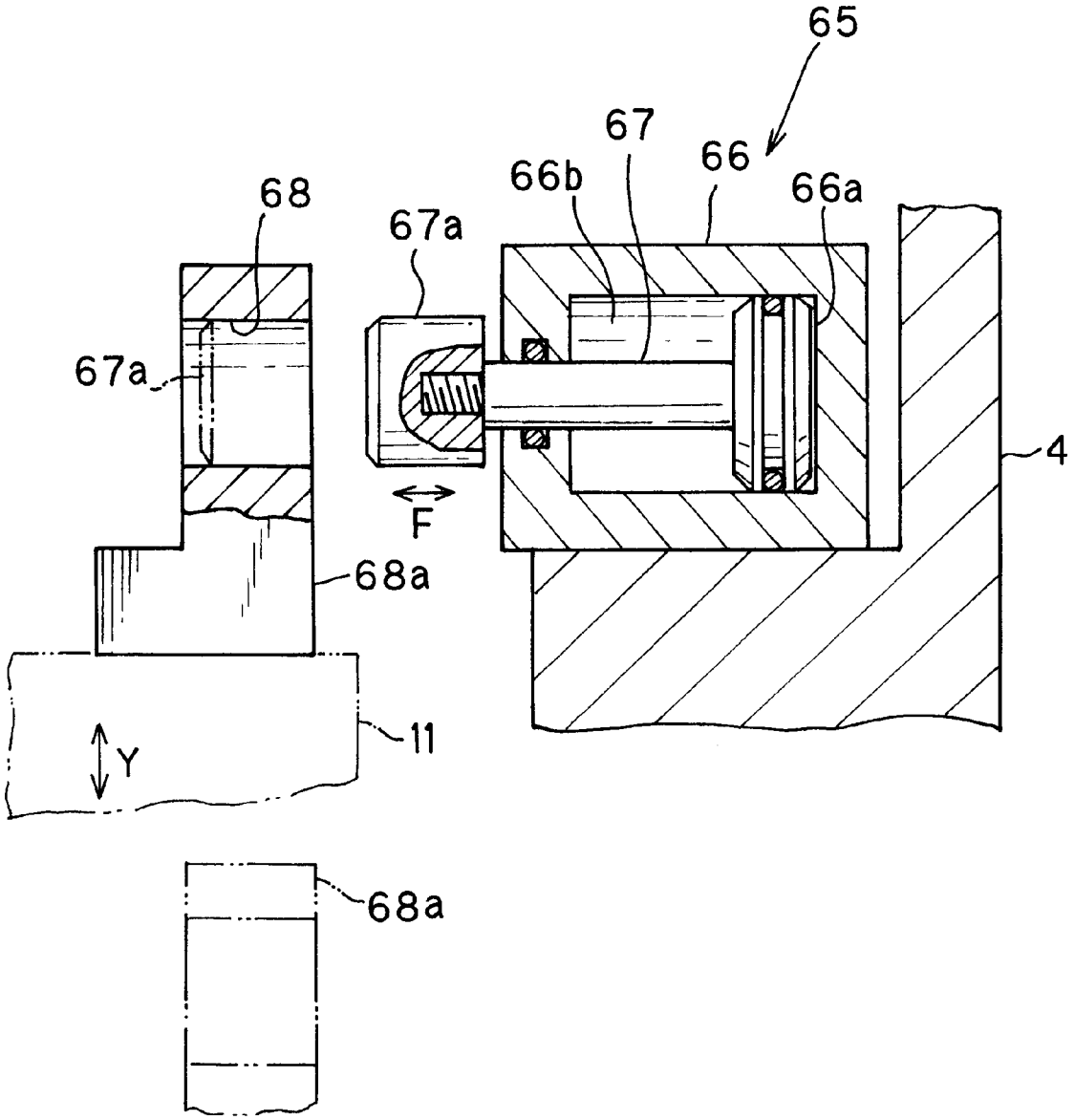

FIG. 1 is a perspective view of a grinding machine. FIG. 2 is a schematic structural view showing a primary part of the grinding machine. FIG. 3 is a cross-sectional view showing a structure of a coupling and releasing means. FIG. 4 is a schematic view showing a structure of a holding means.

Figure 5A:
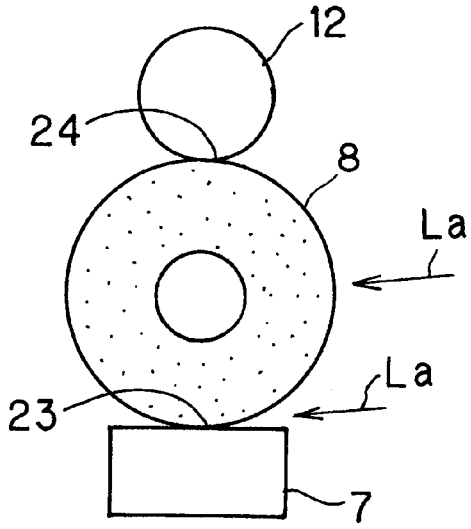
Figure 5B:
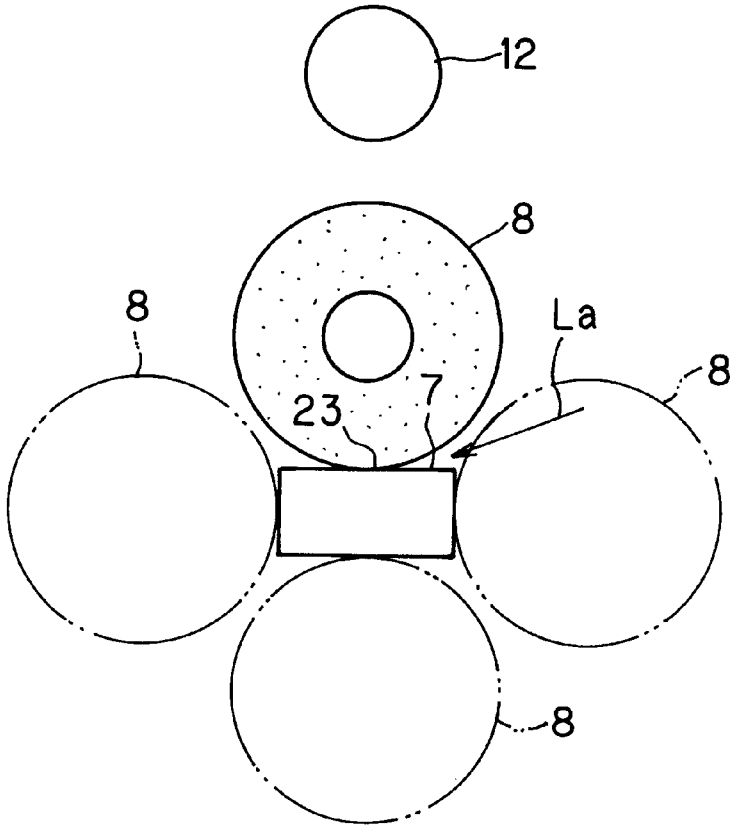

FIGS. 5A and 56 are illustrations of the grinding machine. FIG. 5A shows a condition of a grinding with continuous dressing. FIG. 5B shows a condition of a normal grinding except for the grinding with continuous dressing.

As shown in FIGS. 1 and 2, in the grinding machine 1, a column 4 is implanted on a bed 3 so as to be movable along a horizontal direction. A spindle head 5 is provided to be movable up and down in the column 4.

A main spindle 6 is rotatably supported to the spindle head 5. The main spindle 6 is drivingly rotated by a spindle motor (not shown). A grinding wheel 8 which is used as a tool for grinding a workpiece 7 is detachably mounted at a front end portion of the main spindle 6.

A well known tool clamping and unclamping mechanism which detachably mounts, at a spindle nose, a tool having a BT tool shank (7/24 Taper tool shank) and a two surface restricted tool such as HSK (Hohl Shaft Kegel) tool is provided on the main spindle 6.

Incidentally, assume that a Z-axis direction be a direction in parallel with an axis of the main spindle 6, and an X-axis direction (an axis in a horizontal direction) and a Y-axis direction (an axis in a vertical direction) be axis directions intersecting the Z-axis and constituting a perpendicular coordinate system, respectively.

A pair of parallel guide rails (for an X-axis guideway) 25 are provided in the X-axis direction on a top surface of the bed 3. The column 4 is disposed to be movable in the X-axis direction along the pair of guide rails 25. The X-axis guideway for guiding the column 4 may be selected from a rolling guide and a plain bearing guideway or the like.

The column 4 moves to-and-fro along the X-axis direction on the bed 3 through an X-axis ball screw (not shown) by an X-axis servomotor.

The spindle head 5 is composed of a head body portion 30, supported movably to the column 4, and a nose portion 31 projecting from the head body portion 30 in the Z-axis direction. A pair of parallel guide rails (for a Y-axis guideway) 32 are provided in the Y-axis direction on the column 4. The head body portion 30 is guided along the guide rails 32 to move along the Y-axis direction. The Y-axis guideway for guiding the spindle head 5 may be selected from a rolling guide, a plain bearing guideway or the like.

A screw shaft 33 of a Y-axis ball screw is arranged in the Y-axis direction in parallel with the guide rails 32. A nut (not shown) fixed to the head body portion 30 is screwed on the screw shaft 33.

The screw shaft 33 is drivingly rotated along forward and reverse directions by a Y-axis servomotor 35 mounted on the top portion of the column 4. When the screw shaft 33 is driven and rotated by the Y-axis servomotor 35, the spindle head 5 is guided by the guide rails 32 through the nut to be moved to-and-fro along the Y-axis direction.

A pair of parallel guide rails (for a Z-axis guideway) 75 are provided in the Z-axis direction on the top surface of the bed 3. A table 13 is movably disposed in the Z-axis direction along the pair of guide rails 75. The Z-axis guideway for guiding the table 13 may be selected from a rolling guide, a plain bearing guideway or the like.

When a Z-axis servomotor (not shown) is driven, the table 13 is guided along the guide rails 75 through a ball screw (not shown) and is moved to-and-fro along the Z-axis direction. The table 13 is provided to be rotatable in a B-axis direction (about the Y-axis) and may index so that the workpiece 7 may be rotated about the B-axis to be indexed.

Incidentally, the driving means for the movement and operation along the X-, Y- and Z-directions have been described as the servomotors and the ball screws in the embodiment. However, it is possible to use any other suitable driving means such as linear motors.

Also, the explanation has been given by exemplifying the grinding machine 1 in which the movement along the X-direction is the movement of the column 4, the movement along the Y-direction is the movement of the spindle head 5 and the movement along the Z-direction is the movement of the table 13. However, the movements are not limited to this manner. Namely, it is essential to use the grinding machine in which the spindle head on which the grinding wheel is mounted may be moved relative to the workpiece along at least three mutually transverse axes including the direction in parallel with the axis of the main spindle.

An index head 78 is provided on a top surface of the table 13 so as to be rotatable and to index along an A-axis direction (a horizontal axis direction perpendicular to the B-axis). The index head 78 detachably supports the workpiece 7 through a mounting member 77 and at the same time rotates the workpiece 7 about the A-axis to index the rotational angle.

A tool magazine 15 which accommodates a single or a plurality of grinding wheels 8 is provided on a side of the bed 3. An automatic tool changer (hereinafter referred to as ATC) 14 for automatically changing the grinding wheels 8 is provided in a body of the tool magazine 15.

The ATC 14 has a tool changing arm 16 of twin-arm-type. The ATC 14 performs a tool changing operation between the main spindle 6 and the tool magazine 15 by the tool changing arm 16.

The tool changing arm 16 detachably grips the grinding wheels 8 by one grip portion 17 and the other grip portion 18. The tool changing arm 16 swivels and moves back and forth along an axial direction of a swivel axis to perform a changing operation of the grinding wheels 8 for receiving pots of the tool magazine 15 and the main spindle 6.

The grinding wheel 8 mounted on the main spindle 6 by the ATC 14 and the workpiece 7 on the table 13 are moved and/or rotated along the three mutually transverse axes X, Y and Z including the direction in parallel with the main spindle axis CL and along the A-axis and B-axis directions, and simultaneously the main spindle 6 is drivingly rotated to thereby perform the grinding of the workpiece 7 by the grinding wheel 8.

A coolant supplying unit (not shown) is provided on a side portion of a machine body of the grinding machine 1. The coolant supplying unit supplies coolant to a grinding position, or the like, between the grinding wheel 8 and the workpiece 7 through a coolant nozzle (hereinafter referred to as a nozzle) 21 mounted on the spindle head 5.

The nozzle 21 is provided to be movable along a direction round the axis CL of the main spindle 6 and along the direction of the axis CL of the main spindle 6. As shown in FIGS. 5A and 5B, the nozzle 21 injects and supplies coolant La at respective predetermined pressures to the grinding position 23 and a periphery 9 (see FIG. 2) of the grinding wheel 8.

A continuous dressing device 10 of the grinding machine 1 will now be described.

The continuous dressing device 10 for continuously dressing the grinding wheel 8, while the grinding machine 1 grinds the workpiece 7, is provided on the column 4 and is guided to be movable along the guide rails 32. Namely, a dressing device body 11 of the continuous dressing device 10 is provided on the column 4 to be movable along the Y-axis direction relative to the spindle head 5 but is provided separately from the spindle head 5.

A dresser supporting member 45 is provided to be movable relative to the dressing device body 11 along the Y-axis direction perpendicular to the axial direction of the main spindle 6. A dresser (dressing tool) 12 supported rotatably to the dresser supporting member 45 is rotated so as to dress the grinding wheel 8.

According to the present invention, while the grinding machine 1 grinds with continuous dressing in which an operation of dressing the grinding wheel 8 with the dresser 12 and an operation of grinding the workpiece 7 with the grinding wheel 8 are simultaneously performed, the dressing device body 11 is moved to at least one dressing position in which the dresser 12 may dress the grinding wheel 8 in the vicinity of the spindle head 5. Thus, the workpiece 7 is ground by the grinding wheel 8 while the grinding wheel 8 is being dressed by the dresser 12.

On the other hand, when the normal grinding except for the grinding with continuous dressing is to be performed, the dressing device body 11 is kept far away from the spindle head 5 in a positive manner so that the dressing device body 11 is moved to at least one retracted position at which the workpiece 7 and at least dresser 12 (the continuous dressing device 10 in this case) do not interfere with each other. Thus, the grinding wheel 8 is moved relatively round the workpiece 7 so that the workpiece 7 may be ground by the grinding wheel 8.

A dresser supporting member 45 which is moved to-and-fro by a dresser-axis servomotor 47 is provided on the dressing device body 11. A pair of parallel guide rails (for a V-axis guideway) 44 are provided on the dressing device body 11 in the V-axis direction in parallel with the Y-axis direction. The dresser supporting member 45 is guided along the pair of guide rails 44 and is moved along the V-axis direction. The V-axis guideway for guiding the dresser supporting member 45 may be selected from a rolling guide, a plain bearing guideway or the like.

A screw shaft 46 of a ball screw for the V-axis is disposed between the two guide rails 44 in parallel with the guide rails 44. A nut (not shown) fixed to the dresser supporting member 45 is screwed on the screw shaft 46.

The screw shaft 46 is drivingly rotated along forward and reverse directions by the dresser-axis servomotor 47 mounted on the dressing device body 11. When the screw shaft 46 is driven and rotated by the dresser-axis servomotor 47, the dresser supporting member 45 moves to-and-fro along the V-axis direction while being guided by the guide rails 44 through the nut.

Since the dresser supporting member 45 is driven and moved along the V-axis direction by the dresser-axis servomotor 47, it is possible to perform the dressing by moving the dresser 12 inch by inch at a predetermined amount.

A dresser rotational driving motor 48 is built in the dresser supporting member 45. The dresser 12 has an axis $CL_1$ in a direction in parallel with the axis CL of the main spindle 6. In order to rotatably support a shaft of the dresser 12 to the dresser supporting member 45, both end portions of the shaft of the dresser 12 are rotatably supported by bearing units 49 and 50 incorporating therein bearings. The dresser 12 is drivingly rotated by the dresser rotational driving motor 48 through pulleys 51 and 52 and a belt 53.

A portion 93 to be detected is provided on the dressing device body 11. It is detected that the dressing device body 11 is located in the retracted position by detecting the detected portion 93 by a first detector $S_5$ mounted on the column 4. A proximity switch, a limit switch, or the like, may be used as the first detector S, and a detector to be described later.

Coupling and releasing means 54 are provided for coupling the spindle head 5 and the dressing device body 11. The coupling and releasing means 54 has a function to couple the spindle head 5 and the dressing device body 11 with each other while the grinding machine 1 grinds with continuous dressing, but to release the coupling between the spindle head 5 and the dressing device body 11 from each other while the grinding machine 1 normally grinds the workpiece 7. The dressing device body 11 is moved and controlled along the Y-axis direction together with the spindle head 5 when it is kept under a coupled condition by the coupling and releasing means 54.

The coupling and releasing means 54 may be formed into a single unit. However, in this embodiment, one set and two sets of coupling and releasing means 54 are provided on the nose portion 31 and the head body portion 30, respectively. Namely, three sets of coupling and releasing means 54 are provided in total. Thus, the plurality of coupling and releasing means 54 are provided between the spindle head 5 and the dressing device body 11 so that a balance of loads and a distribution of loads are aimed upon coupling.

As shown in FIGS. 2 and 3, in the coupling and releasing means 54, a projection 55 projecting in a direction (upward direction) of the dressing device body 11 is fixed to the spindle head 5. A portion 56, to be engaged, having the same shape as that of a retention knob is provided at a tip end of the projection 55. A clamping and unclamping means 57 for clamping and unclamping the projection 55 is provided in an interior of the dressing device body 11.

The clamping and unclamping means 57 has a drawbar 58. Center axes D of the drawbar 58 and the projection 55 are identified with each other to be directed in a direction in parallel with the Y-axis. The drawbar 58 is retractable in a direction of the center axis D as indicated by an arrow E by a clamping and unclamping cylinder unit 59 mounted on the dressing device body 11.

A plurality of ball-like engaging members 62 are provided at an end of the drawbar 58 to be movable radially. When the drawbar 58 is raised by the feed of pressure fluid (for example, pressurized oil or pressurized air) to a first cylinder chamber 59*c*, the engaging members 62 may be engaged with the portion 56 to be engaged. This engaging members 62 grip and clamp the portion 56 to be engaged.

Thus, the projection 55 is clamped to the dressing device body 11 through the engaging members 62 and the portion 56 to be engaged. It is therefore possible that the dressing device body 11 is coupled with the spindle head 5 and moves to-and-fro along the Y-axis direction together with the spindle head 5.

In order to bring the clamping and unclamping means 57 to an unclamping condition, pressure fluid is fed into a second cylinder chamber 59*d* of the clamping and unclamping cylinder unit 59 to move a piston rod 59*a* downwardly to press the drawbar 58 downwardly.

Then, an engaging condition between the engaging members 62 and the portion 56 to be engaged is released. Accordingly, the projection 55 is separated away from the drawbar 58 to thereby release the coupling between the spindle head 5 and the dressing device body 11.

The clamping condition and the unclamping condition of the clamping and unclamping means 57 are confirmed by detecting the portion 91, to be detected, coupled with the piston rod 59*a* of the clamping and unclamping cylinder unit 59 by detectors $S_4$ and $S_3$, respectively.

Incidentally, in the embodiment, the clamping and unclamping means 57 clamps the portion 56, to be engaged, which is gripped by the balls 62. However, it is possible to adopt a clamping and unclamping mechanism having a collet for gripping the portion 56 to be engaged.

Also, in the embodiment, the drawbar 58 is directly raised and lowered by the clamping and unclamping cylinder unit 59. It is however possible to operate either drawbar or cylinder unit by a spring force of a spring. For example, the operation may be made by a driving force of the cylinder unit during an unclamping operation and may be made by the spring force during a clamping operation.

Furthermore, the clamping and unclamping means 57 may be a means for performing a clamping and unclamping operation through a screw mechanism by an actuator.

As shown in FIGS. 2 and 4, a holding means 65 has a function to retain the dressing device body 11, which is retracted far away from the spindle head 5, at the column 4 in the predetermined retracted position while the grinding machine 1 normally grinds the workpiece 7 by the grinding wheel 8.

In the embodiment, a holding cylinder unit 66 constituting the holding means 65 is mounted on the column 4. In the holding cylinder unit 66, an engaging portion 67*a* provided at an end of a piston rod 67 performs a retracting and projecting operation as indicated by an arrow F by feeding pressure fluid.

A retainer member 68*a* is mounted on the dressing device body 11. A hole 68 to be detachably engaged with the engaging portion 67*a* is formed in the retainer member 68*a*.

When pressure fluid is fed to one cylinder chamber 66*a* of the cylinder unit 66 while the dressing device body 11 is located in the retracted position, the piston rod 67 is projected forwardly and then the engaging portion 67*a* engages with the hole 68. Thus, the dressing device body 11 is retained at the column 4 through the holding means 65 in the retracted position. Also, when pressure fluid is fed to the other cylinder chamber 66*b*, the engaging portion 67*a* is released from the engaged hole 68 to release an engaging condition.

Incidentally, in the holding means, the holding cylinder unit may be of a type in which one of movement operations is performed by a biasing force of a spring. Also, it is possible to convert a rotational operation of an actuator into a linear movement by a screw mechanism. Furthermore, the actuator may be of an electric type rather than a pressure fluid type.

A portion 92 to be detected is mounted on the head body portion 30 of the spindle head 5. The portion 92 may be detected by second and third detectors $S_6$ and $S_7$ mounted on the column 4.

The detector $S_6$ detects the fact that the spindle head 5 reaches an upper limit position. The detector $S_7$ detects the fact that the spindle head 5 reaches a lower limit position.

A balancing fluid pressure cylinder 40 to be used as a balancing device for maintaining a weight balance of the continuous dressing device 10 is provided between the column 4 and the dressing device body 11. A piston rod 39 of the balancing fluid pressure cylinder 40 is coupled with the dressing device body 11.

Namely, the balancing fluid pressure cylinder 40 normally draws the dressing device body 11 along a direction, in which the body 11 is raised, with a load substantially balanced with a weight of the continuous dressing device 10.

Thus, even when the spindle head 5 and the continuous dressing device 10 are integrally coupled with each other, a movement control may be performed suitably without imparting an extra load to the Y-axis servomotor 35.

Incidentally, the above-described balancing device may maintain the weight balance with the continuous dressing device 10 by using a balancing weight.

An operation of the grinding machine 1 will now be described.

As a result of which the tool change is performed between the tool magazine 15 and the main spindle 6 by an operation of the tool changing arm 16, or the like, of the ATC 14, the desired grinding wheel 8 is mounted on the main spindle 6 and the dressing device body 11 is retained at the column 4 by the holding means 65 in the retracted position.

In the case where the grinding with continuous dressing for continuously dressing the grinding wheel 8, while the grinding machine 1 grinds the workpiece 7, is to be performed (see FIG. 5A), it is necessary to couple the spindle head 5 and the dressing device body 11 with each other.

To this end, first of all, pressure fluid is fed into the second cylinder chambers 59*d* of the three clamping and unclamping cylinder units 59 to move the piston rods 59*a* downwardly.

Thus, since the drawbars 58 of the clamping and unclamping means 57 move downwardly, the three clamping and unclamping means 57 are kept under the unclamping condition. A condition in which the operations of the clamping and unclamping means 57 are kept under the unclamping condition is confirmed by the detector $S_3$ for detecting the portion 91 to be detected.

Subsequently, the Y-axis servomotor 35 is driven to raise the spindle head 5 up to a predetermined coupled position. As a result, the projections 55 of the spindle head 5 are inserted into the clamping and unclamping means 57 so that the portions 56 to be engaged and the engaging members 62 may be engaged with each other.

Then, a feeding direction of pressure fluid to the clamping and unclamping cylinder units 59 is switched over. Then, since pressure fluid is fed into the first cylinder chambers 59*c*, the piston rods 59*a* and the drawbars 58 are moved upwardly.

Thus, since the engaging members 62 grip the portion 56 to be engaged, the three clamping and unclamping means 57 are brought into the clamping condition so that the spindle head 5 and the dressing device body 11 are coupled with each other.

Pressure fluid is fed into the other cylinder chamber 66*b* of the holding means 65 so that the engaging portion 67*a* is separated away from the engaged hole 68 of the retainer member 68*a*.

Subsequently, when the Y-axis servomotor 35 is driven and controlled, the spindle head 5 and the dressing device body 11 are moved together along the Y-axis direction. When the dresser-axis servomotor 47 is driven, the dresser supporting member 45 is moved along the V-axis direction through the ball screw so that the dresser 12 is brought into contact with or separated away from the grinding wheel 8.

When the dresser 12 which is drivingly rotated by the dresser rotational driving motor 48 is brought into contact with the grinding wheel 8, it is possible to dress the grinding wheel 8. Since the dresser 12 is supported at both ends by the dresser supporting member 45, there is no fear that the dresser 12 is away from the grinding wheel 8 due to the load upon dressing.

When the grinding with continuous dressing is kept on, a diameter of the grinding wheel 8 is gradually decreased. For this reason, in response to a change of the diameter, the dresser-axis servomotor 47 is driven and the dresser supporting member 45 is moved on the direction of the spindle head 5. Then, the dresser 12 continuously dresses the grinding wheel 8. Incidentally, although a diameter of the dresser 12 is also gradually decreased, this is a small change in comparison with the grinding wheel 8.

Thus, the spindle head 5 and the dressing device body 11 are coupled together with each other and are moved and controlled along the Y-axis direction. The column 4 and the table 13 are moved and controlled along the X-axis and Z-axis directions, respectively. Furthermore, the workpiece 7 is rotated about the B-axis and the A-axis by the table 13 and the index head 78, respectively, and the main spindle 6 is drivingly rotated. Thus, it is possible to grind the workpiece 7 with the grinding wheel 8 while the dresser 12 continuously dresses the grinding wheel 8.

While the grinding machine 1 grinds with continuous dressing, coolant La fed from the coolant supplying unit is injected to the grinding position 23 from the nozzle 21 so as to prevent the heat generation upon the grinding. Coolant La from the nozzle 21 is also injected substantially along a normal line direction to the periphery 9 of the grinding wheel 8 so that dressing chips, or the like, generated from the grinding wheel 8 in the dressing position 24 are blown out.

An operation in the case where the operation will be moved to the normal grinding (see FIG. 5B) after the above-described grinding with continuous dressing (see FIG. 5A) will now be described.

In order to release the coupling between the spindle head 5 and the dressing device body 11, first of all, the Y-axis servomotor 35 is drivingly controlled so that the spindle head 5 is moved up to the predetermined coupled position along the Y-axis direction. Pressure fluid is fed into the one cylinder chamber 66a of the holding means 65 so that the engaging portion 67*a* is inserted in the hole 68, to be engaged, of the retainer member 68*a*.

Subsequently, pressure fluid is fed into the second cylinder chambers 59*d* of the three clamping and unclamping cylinder units 59. Thus, the drawbars 58 of the clamping and unclamping means 57 are moved downwardly through the piston rods 59*a*.

Thus, the clamping and unclamping means 57 are brought into the unclamping condition so that the dressing device body 11 and the spindle head 5 are released away from each other from the coupling condition. The spindle head 5 is moved downwardly by the servomotor 35 to a working location for the grinding operation.

Since the dressing device body 11 has been moved at the retracted position, as shown in FIG. 5B, the grinding wheel 8 is moved relatively round the workpiece 7 as desired to thereby grind the workpiece 7. Namely, it is possible to perform the grinding over an entire circumference of the workpiece 7.

While the grinding machine 1 grinds the workpiece 7, the nozzle 21 is moved along the direction round the axis CL of the main spindle 6 and along the direction of the axis CL so that coolant La is fed to the grinding position 23.

Since the dressing device body 11 is retained at the column 4 by the holding means 65 in the retracted condition, this is safety.

Second Embodiment

Figure 6:
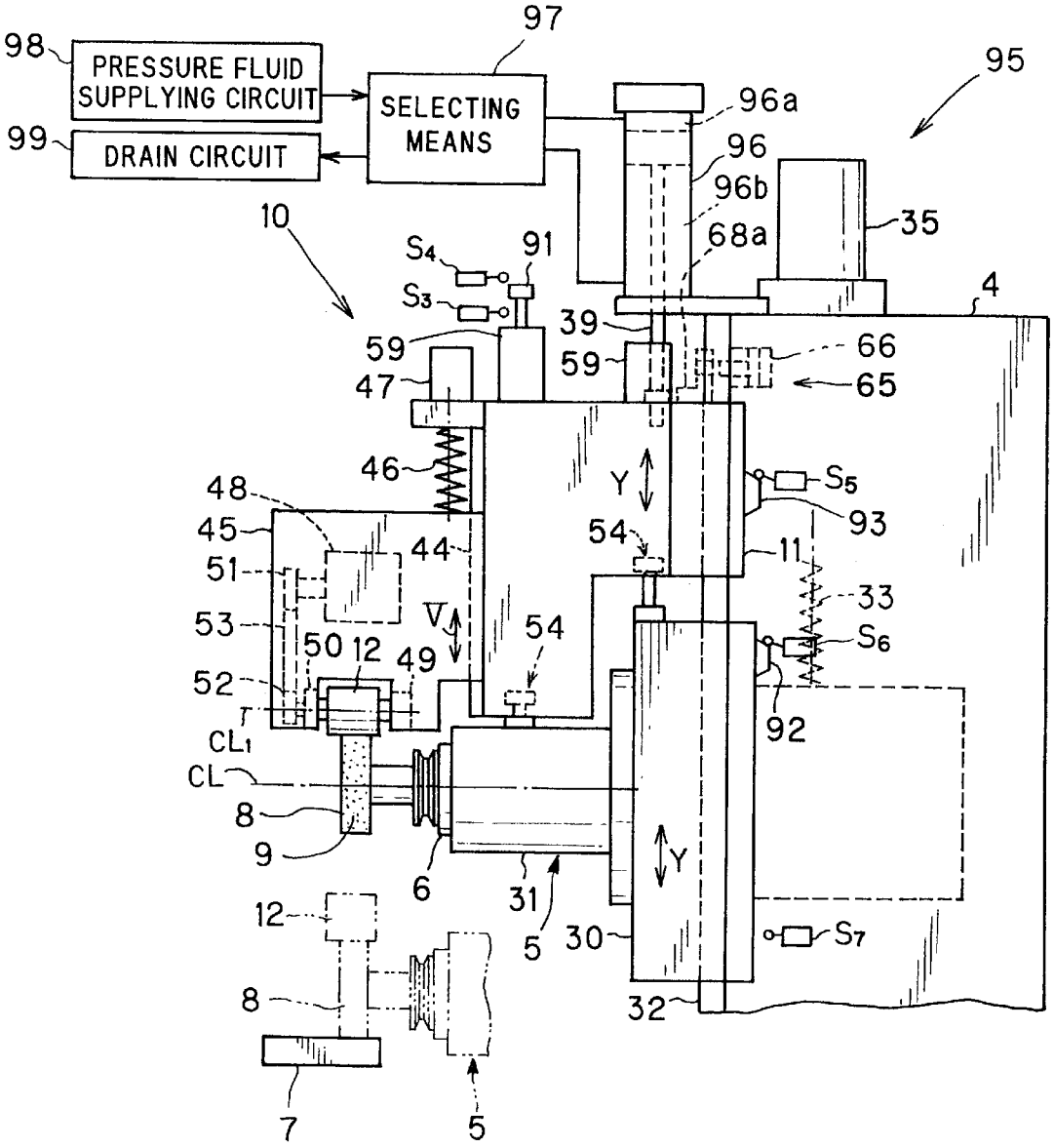
FIG. 6 is a schematic view showing a structure of a primary part of a grinding machine according to a second embodiment of the invention.

FIG. 6 is a schematic view showing a structure of a primary part of a grinding machine 95 in accordance with a second embodiment of the present invention.

In the first embodiment, the dressing device body 11 is moved along the Y-axis direction together with the spindle head 5. As shown in FIG. 6, in the second embodiment, instead of the balancing cylinder 40, a fluid pressure cylinder unit 96 of the dressing device is provided as a driving unit for moving the dressing device body 11 up and down relative to the spindle head 5.

Pressure fluid is fed into one of cylinder chambers 96*a* and 96*b* of the dressing device fluid pressure cylinder unit 96 from a pressure fluid supplying circuit 98 by controlling a selecting means 97 such as a selector valve. The other cylinder chamber, to which pressure fluid is not fed, or both cylinder chambers 96*a* and 96*b* may communicate with a drain circuit 99, which communicates with an atmosphere, by the selecting means 97.

In this case, when the coupling between the dressing device body 11 and the spindle head 5 is released after the grinding machine 95 grinds with continuous dressing, the Y-axis servomotor 35 is driven while the dressing device body 11 and the spindle head 5 are being coupled with each other. Thus, the spindle head 5 is raised up to a predetermined position for coupling and releasing.

Then, in this predetermined position, the clamping and unclamping means 57 is changed to the unclamping condition and the coupling between the dressing device body 11 and the spindle head 5 is released.

Subsequently, the cylinder unit 96 is driven so that the dressing device body 11 is raised up to the retracted position. Thereafter, the dressing device body 11 is retained at the column 4 by the holding means 65. On the other hand, the Y-axis servomotor 35 is driven to move the spindle head 5 downwardly to the working location to carry out the grinding operation.

As a result, the predetermined position at which the spindle head 5 is raised for coupling and releasing by the Y-axis servomotor 35 may be lower than that of the first embodiment. Namely, after the coupling between the dressing device body 11 and the spindle head 5 has been released, a lowering operation of the spindle head 5 to the working location by the Y-axis servomotor 35 and an upward operation of the dressing device body 11 to the retracted position by the cylinder unit 96 may be performed simultaneously. Thus, a time required to couple and release the components may be reduced.

Also, in the second embodiment, while the grinding machine 95 grinds with continuous dressing, when the spindle head 5 and the dressing device unit 11 are coupled thereby to be moved and controlled together, it is desirable that both cylinder chambers 96*a* and 96*b* of the cylinder unit 96 are in communication with the drain circuit 99. Thus, the cylinder unit 96 does not affect the movement control of the spindle head 5.

Third Embodiment

Figure 7:
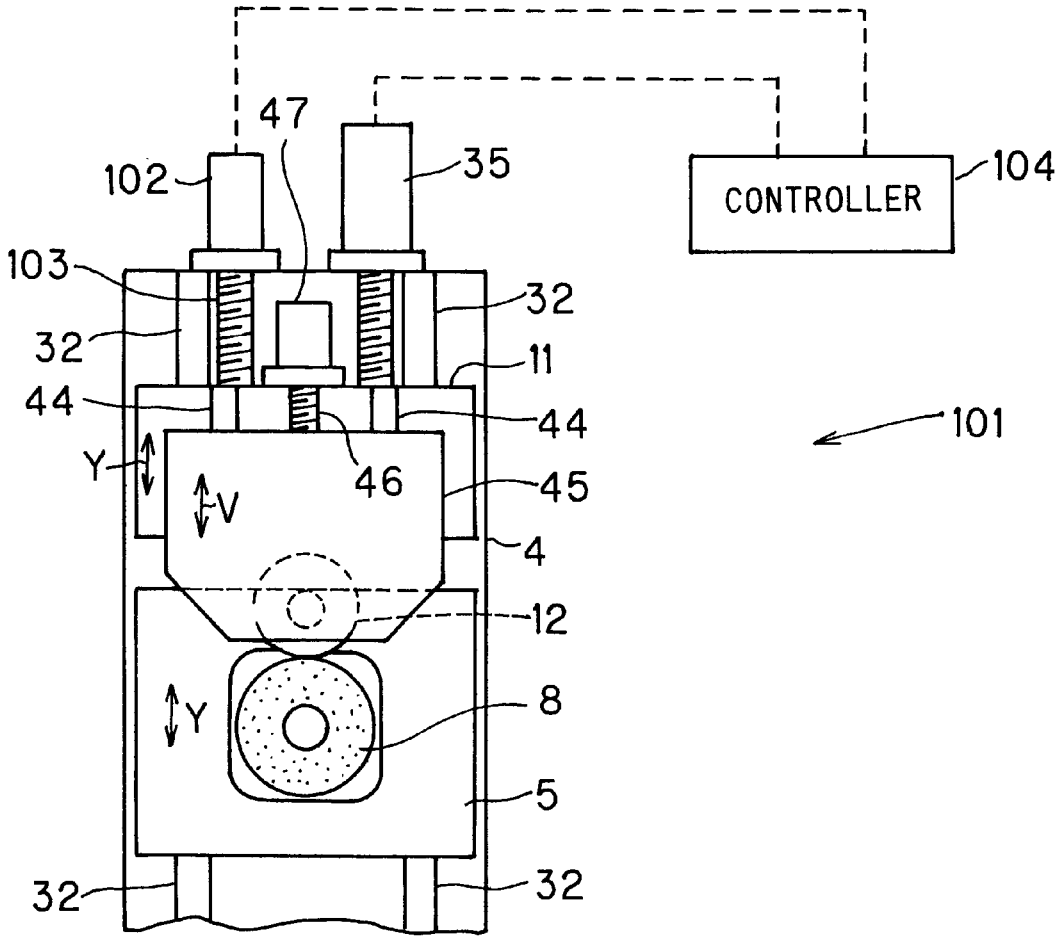
FIG. 7 is a schematic view showing a structure of a primary part of a grinding machine according to a third embodiment of the invention.

FIG. 7 is a schematic view showing a primary part of a grinding machine 101 in accordance with a third embodiment of the present invention.

As shown in FIG. 7, in this embodiment, a servomotor 102 of a continuous dressing device is provided on the column 4 as a driving device for moving the dressing device body 11 relative to the spindle head 5. The Y-axis servomotor 35 and the continuous dressing device servomotor 102 are controlled by a controller 104.

The continuous dressing device servomotor 102 is controlled with a follow-up moving control so that the dressing device body 11 is moved in synchronism with a moving operation of the spindle head 5 along the Y-axis direction while the grinding machine 101 grinds with continuous dressing.

A driving force of the continuous dressing device servomotor 102 is transmitted through a screw shaft 103 of a ball screw and a nut (not shown), which is mounted on the dressing device body 11 and is screwed on the screw shaft 103, so that the dressing device body 11 is moved to-and-fro along the Y-axis direction.

Thus, the means for coupling the spindle head 5 with the dressing device body 11 and for releasing the coupling may become unnecessary. Furthermore, for example, if an electric structure is adopted for the holding means 65, the electric structure dispenses with the hydraulic circuit to thereby simplify an overall structure of the grinding machine 101.

Incidentally, instead of the continuous dressing device servomotor 102, the driving unit for moving the dressing device body 11 relative to the spindle head 5 may be a servo valve and a fluid pressure cylinder unit (for example, a hydraulic cylinder unit) in combination or may be a linear motor. Namely, it is only essential that the driving unit may perform the follow-up moving control so that the dressing device body 11 may be moved in synchronism with the movement of the spindle head 5 while the grinding machine 101 grinds with continuous dressing.

As described in the first to third embodiments, when the dressing device body 11 is disposed in the vicinity of the spindle head 5, it is possible to grind with continuous dressing. Also, it is possible to perform only the dressing.

In the normal grinding except for the grinding with continuous dressing, when the dressing device body 11 is retracted far away from the spindle head 5 in the positive manner, it is possible to relatively move the grinding wheel 8 round the workpiece 7, as desired.

As a result, with only one grinding machine, it is possible to perform both the grinding with continuous dressing and the normal grinding over the entire circumference of the workpiece 7 without the continuous dressing, as desired.

Also, since the single spindle head 5 is simply used, the overall apparatus may be simplified in comparison with a conventional grinding machine having two grinding spindles (see Examined Japanese Patent Publication No. Hei 3-27342).

Since the dressing device body 11 and the dresser supporting member 45 may be retracted far away from the spindle head 5 in the positive manner, it is possible to avoid the interference between the continuous dressing device 10 and the workpiece 7 while the grinding machine normally grinds the workpiece 7.

As a result, the operator may prepare an NC program without paying any attention to the presence or absence of the interference.

Incidentally, the same reference numerals are used to indicate the like parts or the same parts throughout the drawings.

Various details of the invention may be changed without departing from its scope. Furthermore, the foregoing description of the embodiments according to the present invention is provided for the purpose of illustration only, and not for the purpose of limiting the invention as defined by the appended claims and their equivalents.

What is claimed is:

1. A grinding machine comprising:

a main spindle on which a grinding wheel for grinding a workpiece is detachably mounted;

a spindle head for rotatably supporting said main spindle, said spindle head being movable relative to the workpiece along at least three mutually transverse axes including a direction in parallel with an axis of said main spindle;

a dressing device body provided to be movable relative to said spindle head along at least one direction perpendicular to the axis of said main spindle; and a dresser supporting member provided to be movable relative to said dressing device body along one direction perpendicular to the axis of said main spindle, said dresser supporting member rotatably supporting at least one dresser for dressing said grinding wheel, wherein said dressing device body is moved to at least one dressing position in which said dresser dresses said grinding wheel, while said grinding machine grinds with continuous dressing in which an operation of dressing said grinding wheel with said dresser and an operation of grinding the workpiece with said grinding wheel are performed simultaneously; and wherein said dressing device body is moved to at least one retracted position at which the workpiece does not interfere with at least said dresser, while said grinding machine normally grinds except for said grinding with continuous dressing.

2. The grinding machine according to claim 1, further comprising at least one coupling and releasing means, wherein said coupling and releasing means couples said spindle head and said dressing device body with each other while said grinding machine grinds with continuous dressing, but said coupling and releasing means releases the coupling between said spindle head and said dressing device body while said grinding machine normally grinds the workpiece.

3. The grinding machine according to claim 2, wherein said spindle head is provided to be movable along at least one axial direction of two axial directions perpendicular to the axis of said main spindle, and said dressing device body is controlled to move along the one axial direction together with said spindle head when said dressing device body is kept under a coupled condition by said coupling and releasing means.

4. The grinding machine according to claim 2, wherein, in said coupling and releasing means, a projection is fixed to said spindle head to project toward said dressing device body, and a clamping and unclamping means for clamping and unclamping the projection is provided on said dressing device body.

5. The grinding machine according to claim 4, wherein a drawbar of said clamping and unclamping means is identified with a center axis of the projection, and the drawbar is movable back and forth along a direction of the center axis by a clamping and unclamping cylinder unit mounted on said dressing device body, wherein engaging members are provided to be movable in the drawbar, and the engaging members grip a portion to be engaged of the projection when the drawbar is raised through a piston rod by feeding pressure fluid to a first cylinder chamber of the clamping and unclamping cylinder unit so that said clamping and unclamping means is kept under a clamping condition, and wherein in order to bring said clamping and unclamping means into an unclamping condition, pressure fluid is fed into a second cylinder chamber and the drawbar is lowered through the piston rod so that an engaging condition between the portion to be engaged and the engaging members are released, and the projection is separated away from the drawbar.

6. The grinding machine according to claim 2, wherein a plurality of coupling and releasing means are provided between said spindle head and said dressing device body to thereby disperse and balance the load upon coupling.

7. The grinding machine according to claim 1, wherein the movement direction of said dressing device body is in a vertical direction, and a balancing device for maintaining a weight balance is provided for said dressing device body.

8. The grinding machine according to claim 7, wherein said balancing device is a balancing fluid pressure cylinder with its piston rod being connected to said dressing device body, and wherein said balancing fluid pressure cylinder normally pulls said dressing device body upwardly at a load which is balanced substantially with a weight of a continuous dressing device.

9. The grinding machine according to claim 1, wherein a driving unit for moving said dressing device body relative to said spindle head is a dressing device fluid pressure cylinder unit, and wherein said dressing device fluid pressure cylinder unit avoids affecting a movement control of said spindle head while said grinding machine grinds with continuous dressing.

10. The grinding machine according to claim 9, wherein, when the coupling between said dressing device body and said spindle head is to be released after said grinding machine grinds with continuous dressing, said spindle head is raised up to a predetermined position for coupling and releasing while coupling said dressing device body and said spindle head, and then the coupling between said dressing device body and said spindle head is released in the predetermined position, and wherein, after said dressing device fluid pressure cylinder unit is driven so that said dressing device body is raised up to the retracted position, said dressing device body is held while said spindle head is moved downwardly to a working location for a grinding operation.

11. The grinding machine according to claim 9, wherein pressure fluid is fed into one of two cylinder chambers of said dressing device fluid pressure cylinder unit, and pressure fluid is fed from a pressure fluid supplying circuit by controlling a selecting means, and the other cylinder chamber, to which pressure fluid is not fed, or both the cylinder chambers communicate with a drain circuit which is in communication with an atmosphere through the selecting means, and wherein both the cylinder chambers communicate with the drain circuit when said spindle head and said dressing device body are moved to be coupled together with each other while said grinding machine grinds with continuous dressing.

12. The grinding machine according to claim 1, wherein said spindle head is provided to be movable along at least one axial direction of the two axial directions perpendicular to the axis of said main spindle, and wherein a driving unit for moving said dressing device body relative to said spindle head moves and operates said dressing device body in synchronism with a movement and operation along the one axial direction of said spindle head while said grinding machine grinds with continuous dressing.

13. The grinding machine according to claim 12, wherein said driving unit is a continuous dressing device servomotor which performs a follow-up moving control to the movement of said spindle head, and wherein a driving force of the continuous dressing device servomotor is transmitted through a ball screw so that said dressing device body is moved to-and-fro along the one axial direction.

14. The grinding machine according to claim 1, further comprising a holding means for holding said dressing device body in the retracted position while said grinding machine normally grinds the workpiece.

15. The grinding machine according to claim 14, wherein, in a holding cylinder unit of said holding means, an engaging portion provided on a piston rod performs a retracting and projecting operation by feeding pressure fluid, wherein a hole to be detachably engaged with the engaging portion is formed in a retainer member mounted on said dressing device body, and wherein, when pressure fluid is fed into one cylinder chamber of the holding cylinder unit while said dressing device body is kept in the retracted position, the piston rod projects so that the engaging portion engages with the hole to be engaged whereby said dressing device body is retained in the retracted position and, when pressure fluid is fed into the other cylinder chamber, the engaging portion is separated away from the hole to be engaged to release an engaging condition.

16. The grinding machine according to claim 1, wherein a Y-axis guideway is provided on a column in a Y-axis direction perpendicular to the axis of said main spindle, and said spindle head is moved and guided along the Y-axis guideway in the Y-axis direction, and wherein said dressing device body is provided on the column to be guided to be movable along the Y-axis guideway, and said dressing device body is provided to be movable relative to said spindle head along the Y-axis direction but to be separated away from said spindle head.

17. The grinding machine according to claim 16, wherein a V-axis guideway is provided on said dressing device body in a V-axis direction parallel with the Y-axis direction, and said dresser supporting member is guided and moved along the V-axis guideway in the V-axis direction.

18. The grinding machine according to claim 17, wherein a screw shaft of a V-axis ball screw is disposed in parallel with the V-axis guideway, and wherein the screw shaft is rotated and driven by a dresser-axis servomotor mounted on said dressing device body, and said dresser supporting member moves to-and-fro along the V-axis direction while being guided by the V-axis guideway so that said dresser is moved inch by inch to perform a dressing operation.

19. The grinding machine according to claim 1, wherein said dresser supporting member incorporates a dresser rotational driving motor, and said dresser has an axis in a direction in parallel with the axis of said main spindle, and wherein both end portions of said dresser are rotatably supported to said dresser supporting member by bearing units, and said dresser is drivingly rotated by the dresser rotational driving motor.

20. The grinding machine according to claim 1, wherein a portion to be detected is provided on said dressing device body, and a detector detects the portion to be detected so that it is detected that said dressing device body is located in the retracted position.

21. The grinding machine according to claim 1, further comprising a tool magazine for accommodating said grinding wheels, wherein an automatic tool changer is provided in said tool magazine for automatically changing said grinding wheels, and wherein the automatic tool changer performs the tool change between said main spindle and said tool magazine by a tool changing arm.

22. The grinding machine according to claim 1, wherein a coolant nozzle is mounted on said spindle head to be movable along a direction of the axis of said main spindle and along a direction round the axis of said main spindle, wherein said coolant nozzle is provided so as to inject coolant to a grinding position between said grinding wheel and the workpiece and to a periphery of said grinding wheel, wherein, while said grinding machine grinds with continuous dressing, coolant is injected to the grinding position from said coolant nozzle and is injected substantially along a normal line direction to the periphery of said grinding wheel, and wherein, while said grinding machine normally grinds the workpiece, coolant is injected to the grinding position from said coolant nozzle.

* * * * *